US005557939A

United States Patent [19]

Mizukami et al.

[11] Patent Number: 5,557,939

[45] Date of Patent: Sep. 24, 1996

[54] CONTROL SYSTEM FOR ABSORPTION CHILLERS

[75] Inventors: Kazuaki Mizukami, Hirakata; Atsushi Ogawa, Kyoto; Masashi Yasuda, Neyagawa; Masahiro Furukawa; Hidetoshi Arima, both of Gunma; Yoshio Ozawa, Hirakata, all of Japan

[73] Assignee: Sanyo Electric Co. Ltd., Oaska, Japan

[21] Appl. No.: 438,363

[22] Filed: May 10, 1995

[30] Foreign Application Priority Data

May 19, 1994 [JP] Japan ..... 6-131403

[51] Int. Cl.[6] ..... F25B 15/00; G05D 15/00

[52] U.S. Cl. ..... 62/148; 137/389; 236/78 D; 417/36

[58] Field of Search ..... 62/141, 148, 188; 137/389, 395, 392; 122/448.1; 236/78 D; 417/36, 40, 41

[56] References Cited

U.S. PATENT DOCUMENTS 4,061,442 12/1977 Clark et al. ..... 417/36

4,444,545 4/1984 Sanders et al. ..... 417/40 X 5,224,352 6/1993 Arima et al. ..... 62/141

*Primary Examiner*—William E. Wayner

*Attorney, Agent, or Firm*—Nikaido, Marmelstein, Murray & Oram LLP

[57] ABSTRACT

A control system for absorption chillers which comprises a device for measuring operating state data concerning components of the main assembly of the chiller and including the liquid level of a high temperature generator and the degree of opening of a gas valve, and a fuzzy control circuit for calculating the deviation of the liquid level from a target value based on the measured operating state data, predicting a variation in the liquid level from the deviation and another item of the operating state data and calculating a control input as to the inverter frequency of an absorbent pump based on the result of prediction, whereby even when a great disturbance occurs, the liquid level of the generator can be controlled with high responsiveness to minimize the variation of the liquid level.

2 Claims, 6 Drawing Sheets

LIQUID LEVEL DEVIATION eH

GAS VALVE OPENING DEGREE VARIATION dQ

| | NB | NS | ZR | PS | PB |
|---|---|---|---|---|---|
| NB | ZR | | NM | NB | NB |
| NS | | | NS | NM | NM |
| ZR | PM | PS | ZR | NS | NM |
| PS | PM | PM | PS | | |
| PB | PB | PB | PM | | ZR |

CONTROL SYSTEM FOR ABSORPTION CHILLERS

FIELD OF THE INVENTION

The present invention relates to a control system for use in absorption chillers for maintaining an absorbent in a generator at a constant liquid level.

BACKGROUND OF THE INVENTION

As shown in FIG. 5, absorption chillers have an upper shell 1 comprising a condenser 11 and a low temperature generator 12, a lower shell 2 comprising an evaporator 21 and an absorber 22, a high temperature generator 3 incorporating a burner 31, a high temperature heat exchanger 4, a low temperature heat exchanger 5, etc. These components are interconnected by piping to recycle an absorbent through the high temperature generator 3, low temperature generator 12 and absorber 22 by an absorbent pump 6 and realize refrigeration cycles.

In the absorption chiller, the degree of opening of a gas valve 32 is controlled to adjust the supply of fuel gas to the burner 31 and to thereby maintain the temperature of cold water flowing out from the evaporator 21 at a target value. If the liquid level of the absorbent in the high temperature generator 3 rises to excess for one cause or another in the absorption chiller, the absorbent becomes mixed with the vapor flowing toward the condenser 11 to raise the boiling point of the refrigerant, consequently entailing a lower refrigeration efficiency. Accordingly, the absorbent in the high temperature generator 3 is maintained at a constant liquid level by using an inverter control circuit for controlling the speed of rotation of the absorbent pump 6 and a PID control loop which is formed by connecting a PID controller 9 to the main assembly 91 of the chiller equipped with the inverter control circuit as shown in FIG. 6 as an example and which is adapted to control the absorbent level as the variable to be controlled.

For controlling the speed of rotation of the absorbent pump, variations of the inverter frequency are predetermined with the temperature of the high temperature generator taken as a variable and the temperature of cooling water flowing into the absorber 22 (cooling water inlet temperature) taken as a parameter as shown in FIG. 8. The inverter frequency is determined based on actual measurements of high temperature generator temperature and cooling water inlet temperature. The inverter frequency is increased approximately in proportion to the high temperature generator temperature because the internal pressure of the high temperature generator increases as the generator temperature rises, making it difficult for the absorbent to flow into the generator. Further the inverter frequency is increased in inverse proportion to the cooling water temperature because the internal pressure of the upper shell drops as the cooling water temperature decreases, making it easy for the absorbent to flow out from the generator.

Incidentally, the absorption chiller is so adapted that if the liquid level of the absorbent in the high temperature generator exceeds a predetermined upper limit value or drops below a predetermined adjustment value, a safety device functions to stop the absorbent pump in an emergency.

However, with the conventional control system for the absorption chiller, the PID control loop is so designed as to directly control the liquid level of the absorbent in the high temperature generator 3, so that for example when the inlet temperature of cold water flowing into the evaporator 21 varies, the variation is reflected in the cold water outlet temperature, which is in turn reflected in the opening degree of the gas valve 32. The gas valve opening degree is further reflected in the internal temperature of the generator 3 to eventually effect the aforementioned inverter control, the result of which appears as an altered speed of rotation of the absorbent pump.

Thus, the appearance of the altered speed of rotation of the absorbent pump resulting from the variation in the cold water inlet temperature involves a great time lag, such that the PID control is not effected quickly in response to the cold water inlet temperature variation if the variation is abrupt, permitting a great variation of the liquid level in the high temperature generator. If the liquid level exceeds the predetermined upper limit value or drops below the predetermined adjustment value owing to the variation, the absorbent pump will be frequently stopped in an emergency, entailing problems such as a shortened life of the system.

SUMMARY OF THE INVENTION

An object of the present invention is to provide a control system which is capable of controlling the liquid level in the high temperature generator with high responsiveness even when an abrupt change occurs in the cold water inlet temperature to suppress variations in the liquid level to the greatest possible extent.

The present invention provides an absorption chiller of first construction which has regulating valve means for adjusting a heat input to a generator, pump means for recycling an absorbent through the generator and an absorber, and a control system for controlling the amount of adjustment of the regulating valve means and controlling the output of the pump means to maintain the absorbent in the generator at an approximately constant liquid level.

The control system comprises data detecting means for detecting operating state data concerning components of the main assembly of the chiller and at least including the liquid level of the absorbent in the generator and the amount of adjustment of the regulating valve means, and calculating means for calculating the deviation of the liquid level from a target value based on the detected operating state data, predicting a variation in the liquid level from the deviation and another item of the operating state data and calculating a control input for the pump means based on the result of prediction.

More specifically, the operating state data includes the temperature of cold water flowing into the chiller main assembly (cold water inlet temperature) and/or the temperature of cold water flowing out from the chiller main assembly (cold water outlet temperature) in addition to the liquid level of the absorbent in the generator and the amount of adjustment of the regulating valve means.

Further more specifically, the calculating means comprises fuzzy inference means for predicting the variation in the liquid level from the operating state data received as an input signal.

The present invention also provides an absorption chiller of second construction which has pump means for recycling an absorbent through a generator and an absorber, and a control system for controlling the output of the pump means to maintain the absorbent in the generator at an approximately constant liquid level.

The control system comprises data detecting means for detecting an item of or different items of operating state data at least including the liquid level of the absorbent in the generator, main control means for carrying out a specified control rule based on the detected operating state data to calculate a control input for the pump means, emergency detecting means for detecting a variation of the liquid level in the generator departing from a predetermined reference range or the liquid level departing from a predetermined reference range as indicating occurrence of an emergency, and emergency control means for stopping the control operation of the main control means upon detection of the emergency and altering the control input for the pump means to the greatest possible extent to make the liquid level approximate to a target value.

More specifically, the main control means comprises fuzzy inference means for predicting a variation in the liquid level from the operating state data received as an input signal, and calculating means for calculating the control input for the pump means based on the predicted liquid level variation.

With the control system for the absorption chiller of the first construction, not only the deviation of the liquid level in the generator but also the operating state data which is responsible for variations in the liquid level, for example, the amount of adjustment of the regulating valve means (more specifically, variation of a gas valve opening degree), is used for predicting the subsequent variation of the liquid level.

For example, when the amount of adjustment of the regulating valve means (variation of the gas valve opening degree) is a negative value even if the liquid level is-the target value or approximate thereto, it is predicted that the liquid level will subsequently rise in the generator. Accordingly, the control input to the pump means is set to a negative value in advance to decrease the amount of discharge of the absorbent and consequently maintain the absorbent at the constant level in the generator.

Thus, the possible variation in the liquid level can be predicted based on the operating state data such as the amount of adjustment of the regulating valve means, and the control input for the pump means is calculated based on the result of prediction so as to maintain the constant liquid level. Accordingly, even if an abrupt change occurs for example in the cold water inlet temperature, the control input to the pump means is so adjusted as to offset the liquid level variation that could result from the change, whereby a great variation in the liquid level is suppressed.

The operating state data includes in addition to the liquid level of the absorbent in the generator and the amount of adjustment of the regulating valve means the temperature of cold water flowing into the chiller assembly (cold water inlet temperature) and/or the temperature of cold water flowing out from the chiller main assembly (cold water outlet temperature). This incorporates into the liquid level prediction a cause traced back further than the amount of adjustment of the regulating valve means, resulting in more accurate prediction to effect control with improved responsiveness.

When the fuzzy inference means is incorporated into the calculating means, it is possible to express, for example, liquid level deviations and amounts of adjustment of the regulating valve means as fuzzy sets and to give a suitable control rule to the fuzzy sets (see FIG. 2), whereby a suitable pump means control input can be calculated from actual measurements of liquid level deviation and adjustment amount of the regulating valve means, with a predicted liquid variation involved in the input.

The control system for the absorption chiller of the second construction carries out the specified control rule based on the operating state data, for example, a PID control rule based on liquid level deviations in the generator, in the usual state of operation wherein liquid level variations are smaller than a predetermined reference value to calculate the control input for the pump means and adjust the amount of discharge of the absorbent, whereby the absorbent is maintained approximately at the constant level in the generator.

If in this state the current liquid level of the genrator departs from the predetermined reference range or the variation of the level departs from the predetermined reference range for one cause or another, it is likely that the usual control rule will be unable to ensure sufficient responsiveness.

In such an instance of emergency, therefore, the main control means is brought out of the usual control operation, and at the same time, the control input to the pump means is altered to the greatest possible extent, whereby the output of the pump means is rapidly increased or decreased to offset the variation of the liquid level through the adjustment of the amount of discharge of the absorbent. This precludes a great variation of the liquid level of the generator.

When the main control means comprises fuzzy inference means for predicting a variation in the liquid level from the operating state data received as an input signal, and calculating means for calculating the control input for the pump means based on the predicted liquid level variation, it is possible to predict an abrupt change in the liquid level and to calculate a control input for the pump means which will keep the liquid level constant. Accordingly, for example if an abrupt change occurs in the cold water inlet temperature, the control input to the pump means is adjusted so as to offset the liquid level variation that could result from the change, whereby a great change in the liquid level is suppressed.

Transition to an emergency state thus suppressed to the greatest possible extent and the foregoing procedure taken in the case of an emergency assure control of high responsiveness at all times.

Even in the event of a great disturbance such as an abrupt change in the cold water inlet temperature, the control system for the absorption chiller of the invention is adapted to control the liquid level in the high temperature generator with high responsiveness to the disturbance to minimize the variation of the liquid level.

DETAILED DESCRIPTION OF EMBODIMENTS

Figure 5:
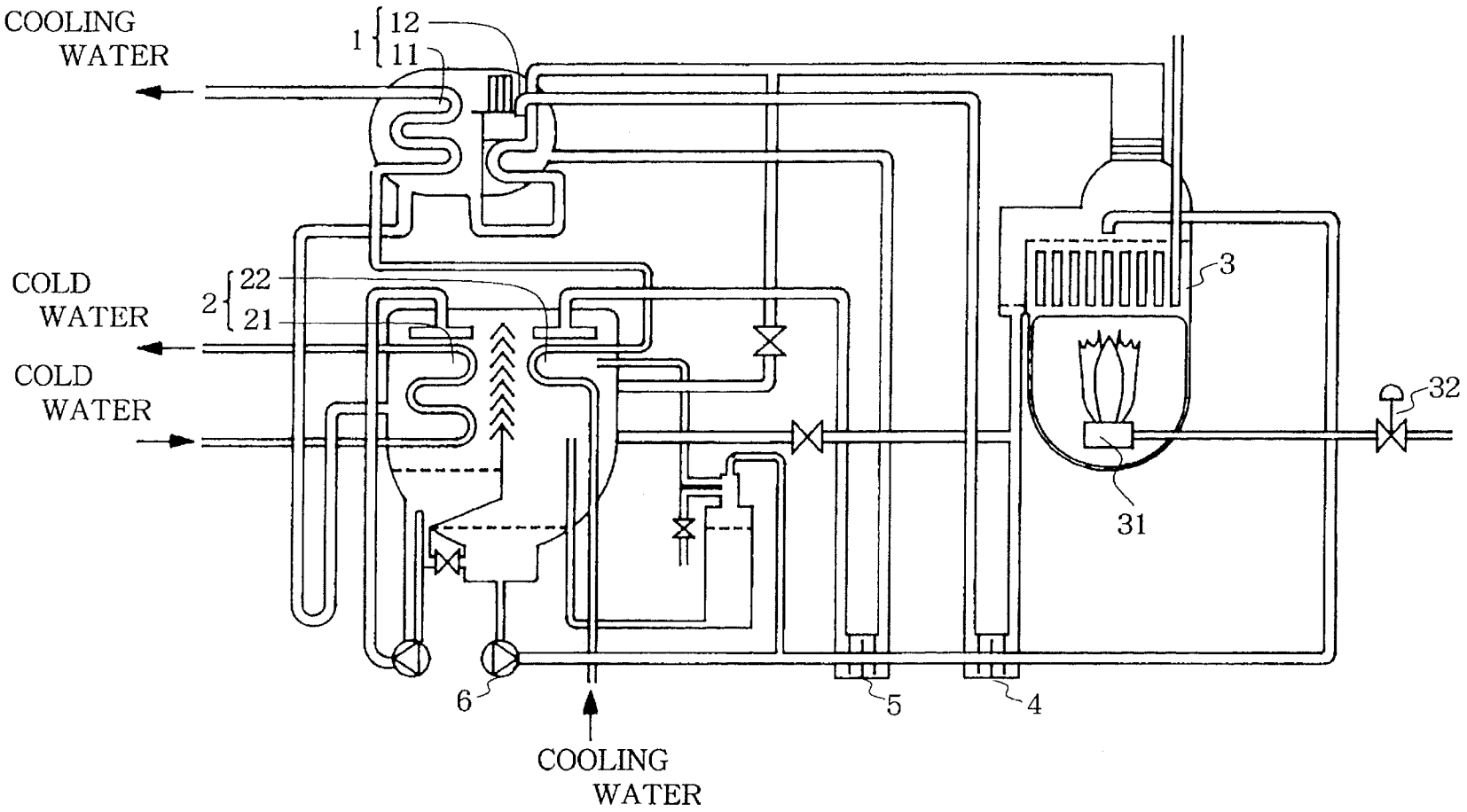
FIG. 5 is a diagram showing the construction of an absorption chiller.
Figure 6:
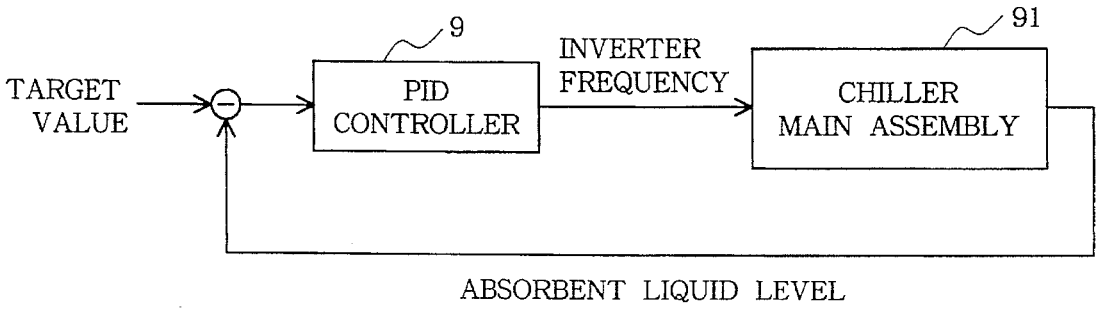
FIG. 6 PRIOR ART
FIG. 6 is a block diagram of a control system including a conventional PID control loop.

Two control systems embodying the invention for the absorption chiller shown in FIG. 5 will be described in detail with reference to the drawings. How to control the absorbent in the high temperature generator 3 at a constant level will be chiefly described below, while the same control methods as conventional methods are practiced for the other components of the chiller main assembly, for example, for adjusting the opening degree of the gas valve 32 in accordance with the cold water inlet temperature. These methods will not be described, therefore.

First Embodiment

Figures 1, 2:
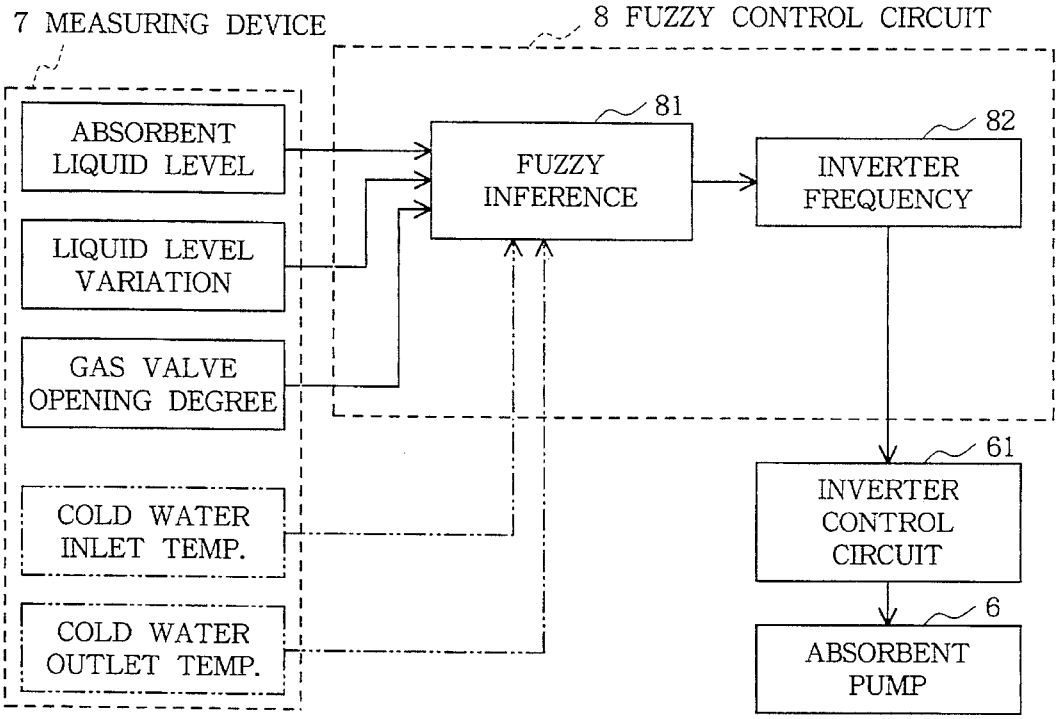
FIG. 1 is a block diagram showing the construction of a control system embodying the invention.
FIG. 2 is a diagram showing a fuzzy control rule.

With reference to FIG. 1, inverter frequency data is fed from a fuzzy control circuit 8 to an inverter control circuit 61 for the absorbent pump 6 to start or stop the absorbent pump 6 and control the speed of rotation of the pump.

The chiller main assembly is provided with a measuring device 7 for measuring the liquid level of the absorbent in the high temperature generator 3, the opening degree of the gas valve 32, the inlet and outlet temperature of the cold water, etc. The measuring device 7 feeds to the fuzzy control circuit 8 operating state data including the absorbent level, variation of the level and gas valve opening degree.

The fuzzy control circuit 8 comprises a fuzzy inference unit 81 and an inverter frequency determining unit 82. As shown in FIG. 2, defined in the fuzzy inference unit 81 is a control rule prescribing variations dQ in the opening degree of the gas valve 32 and deviations eH of the liquid level in the high temperature generator 3 as fuzzy sets. Variations in the liquid level can be predicted based on the rule, and the inverter frequency determining unit 82 determines the inverter frequency to be fed to the inverter control circuit 61 according to the prediction.

The measuring device 7 samples the liquid level and the gas valve opening degree at a predetermined interval, calculates variations in the liquid level and in the valve opening degree from the sampled data and feeds the calculated values to the fuzzy control circuit 8.

Figure 3:
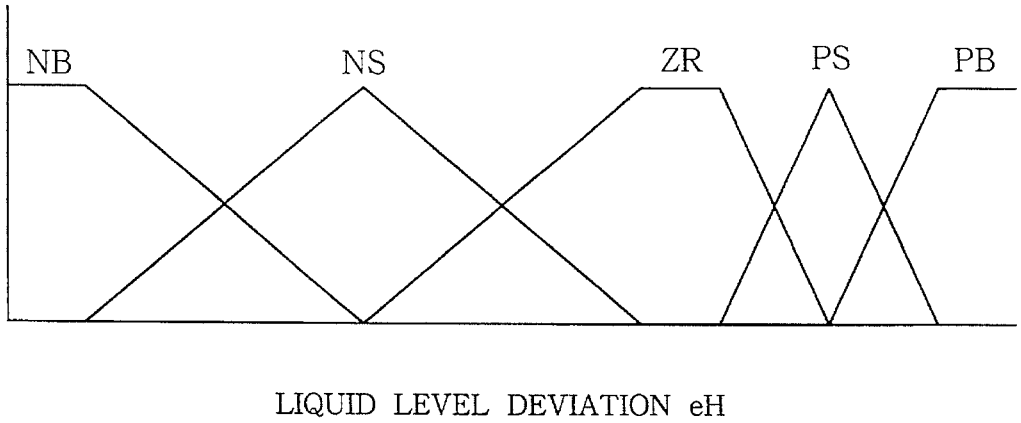
FIGS. 3(*a*) and 3(*b*) are graphs showing membership functions.
Figure 3:
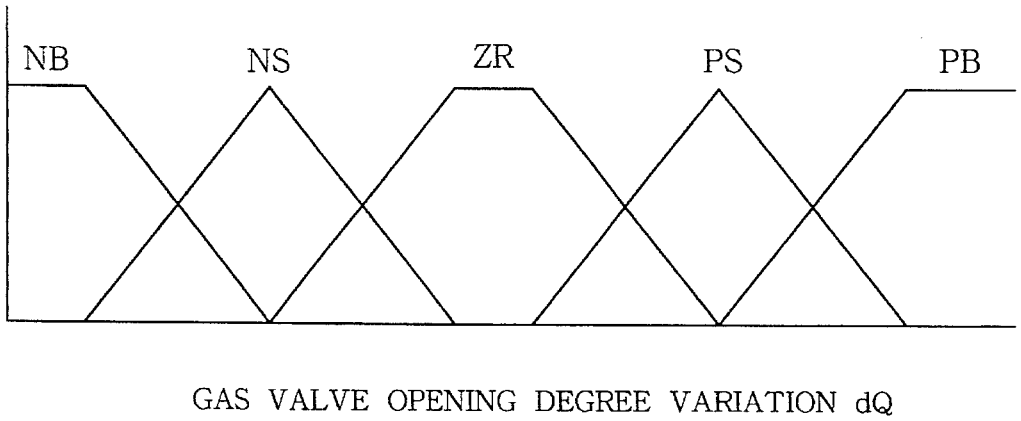

FIG. 3(*a*) shows an example of membership function as to the liquid level deviation eH, and FIG. 3(*b*) shows an example of membership function as to the gas valve opening degree dQ. With reference to FIG. 2, for example if the liquid level deviation eH is zero (ZR) and if the variation dQ of the gas valve opening degree is a negative large value (NB), it is predicted that the liquid level will thereafter rise approximately at a medium rate. Accordingly, the inverter frequency is decreased approximately at a medium rate (NM). As a result, the flow rate of the absorbent discharged from the absorbent pump 6 decreases to offset the rise in the liquid level and maintain the absorbent at a constant level.

Further if the liquid level deviation eH is a negative large value (NB) and if the variation dQ of the gas valve opening degree is a positive large value (PB), it is predicted that the liquid level will thereafter drop greatly. Accordingly, the inverter frequency is increased at a great rate (PB). Consequently the amount of discharge of the absorbent increases to offset the drop in the liquid level and maintain the absorbent at the constant level.

Although fuzzy inference is made based on the liquid level deviation and the variation of the gas valve opening degree according to the foregoing embodiment, it is also possible to measure the cold water inlet temperature and/or the cold water outlet temperature and feed the variations in these temperatures to the fuzzy inference unit 81 along with the liquid level deviation and the gas valve opening degree variation as indicated in dot-and-dash lines in FIG. 1 for the prediction of the liquid level. In this case, the variation of the gas valve opening degree results from the variation in the cold water outlet temperature, and the variation in the cold water outlet temperature from the cold water inlet temperature, so that these temperature variations involved in the fuzzy inference lead to increased predictability for the control of the liquid level with higher responsiveness.

Second Embodiment

Figure 7:
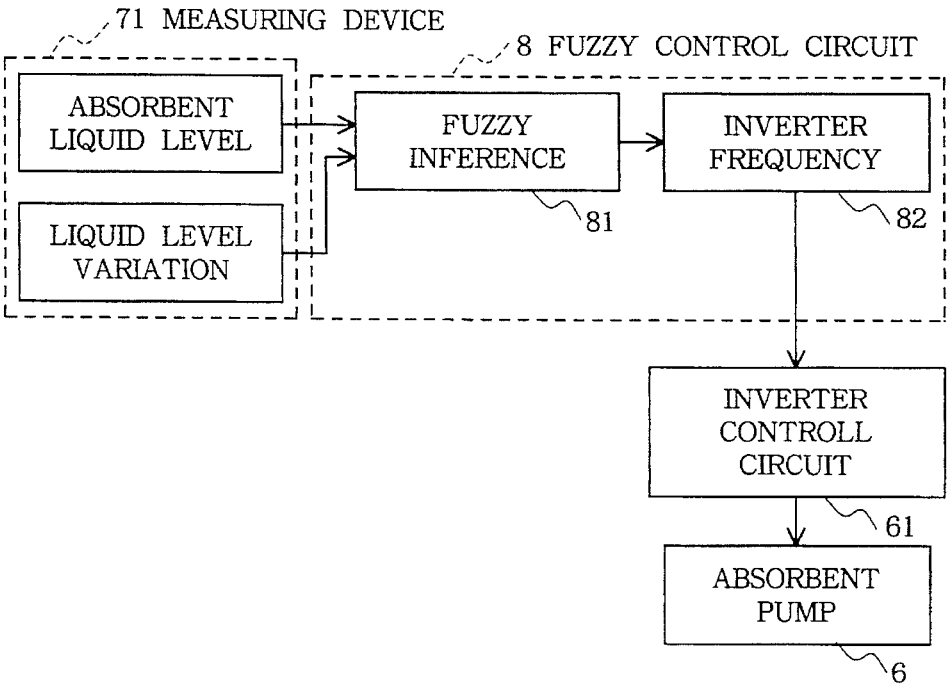
FIG. 7 PRIOR ART
FIG. 7 is a block diagram of a control system wherein a conventional fuzzy control method is used.
Figure 8:
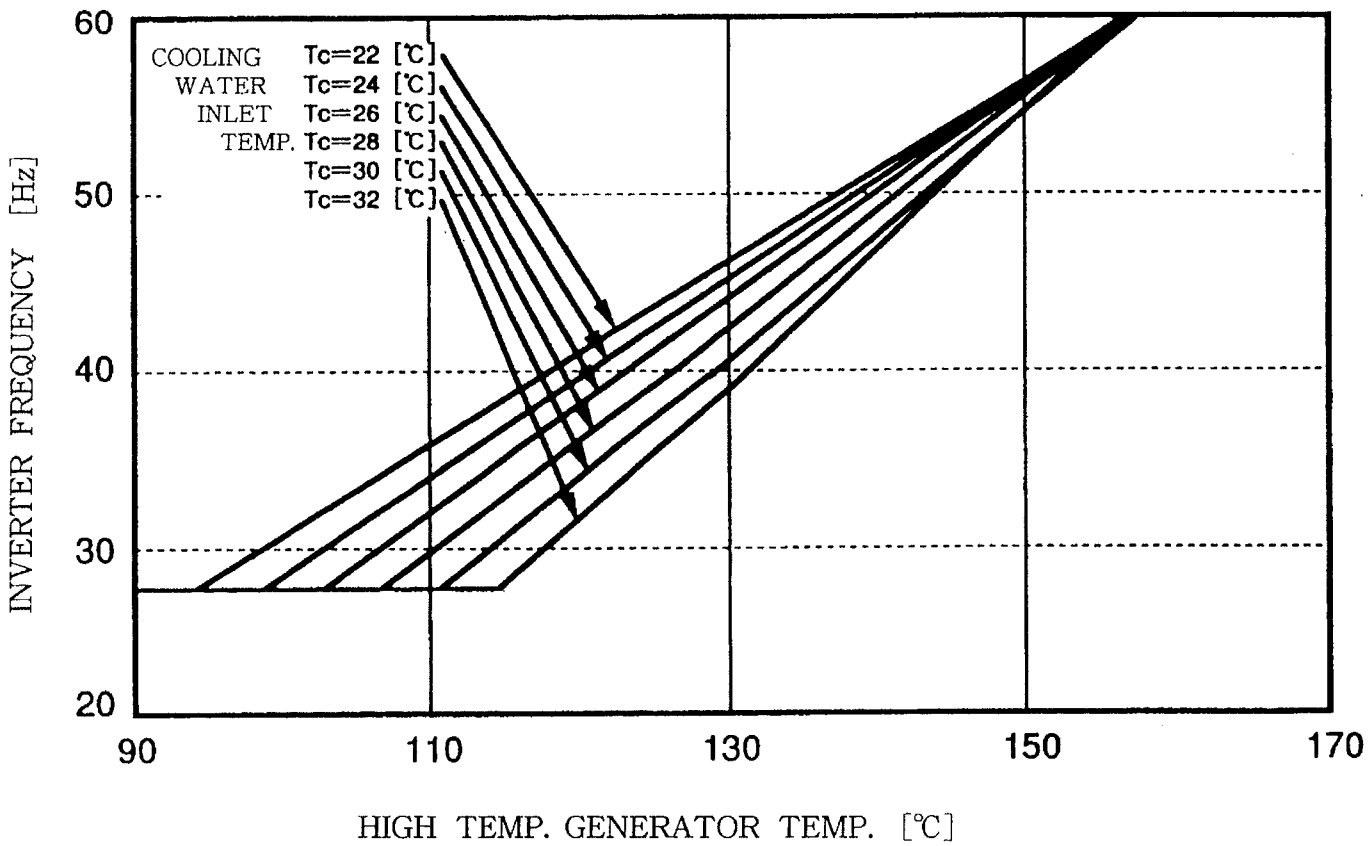
FIG. 8 PRIOR ART
FIG. 8 is a graph for illustrating the principle of inverter control.

FIG. 7 shows the construction of a control system which employs a conventional fuzzy control method and which includes a fuzzy control circuit 8 for executing fuzzy inference as to the inverter frequency based on the liquid level of the absorbent and variation of the liquid level which are fed by a measuring device 71.

In this case, the variation of the gas valve opening degree is not involved in the fuzzy inference unlike the first embodiment. Sufficient predictability is therefore not available as to the liquid level. Further even if the liquid level of the absorbent varies greatly, the control input to be given as to the inverter frequency can not be in excess of the value of PB (positive big) or NB (negative big) prescribed by the fuzzy control rule. In addition, since the speed of rotation of the pump is controlled in predetermined control cycles corresponding to the liquid level sampling interval, the rotational speed of the pump merely varies gradually according to the control input which gradually varies every control cycle.

Therefore, if a great disturbance such as an abrupt change in the cold water inlet temperature occurs, the control input as to the rotational speed of the absorbent pump is not highly resposive to the variation of the liquid level, consequently permitting a great variation in the liquid level.

Figure 4:
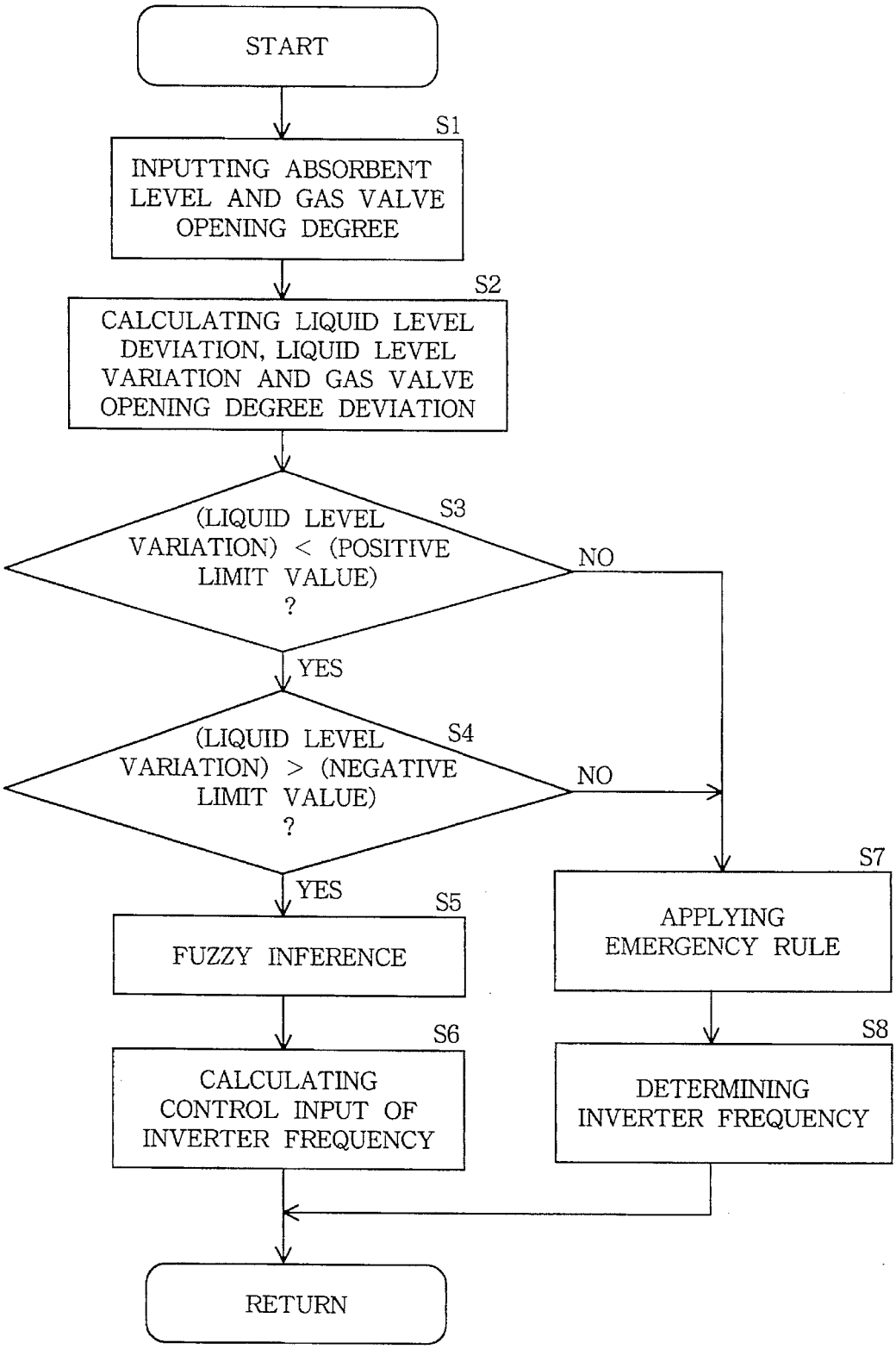
FIG. 4 is a flow chart showing a control algorithm including an emergency rule.

To overcome the drawback of the conventional control system, therefore, the control procedure shown in FIG. 4 is executed in the present embodiment. The control system has the same overall construction as the system shown in FIG. 1.

With reference to FIG. 4, the liquid level of the absorbent and the gas valve opening degree are input to the system first in step S1, and the liquid level deviation, liquid level variation (variation from the preceding sampled value) and deviation of the gas valve opening degree are calculated in step S2. Next, step S3 inquires whether the liquid level variation is below a predetermined positive limit value. When the answer is affirmative, step S4 further inquires whether the liquid level variation is above a predetermined positive limit value.

When the answer to the inquiry of step S4 is in the affirmative, the fuzzy inference of the foregoing first embodiment or the conventional fuzzy inference shown in FIG. 7 is executed in step S5, followed by step S6 in which a control input for the inverter frequency is calculated.

On the other hand, if the answer to the inquiry of step S3 or step S4 is negative, this is interpreted as indicating occurrence of an emergency, and the sequence proceeds to steps S7 and S8, in which an inverter frequency is determined according to the following emergency rule and is fed to the inverter control circuit 61.

Emergency Rule

If the liquid level variation>the positive liquid level variation limit value, then the inverter frequency=a minimum value.

If the liquid level variation<the negative liquid level variation limit value, then the inverter frequency=a maximum value.

Consequently, the speed of rotation of the absorbent pump rapidly varies to the maximum or minimum value to prevent the liquid level in the high temperature generator 3 from varying greatly. The inverter frequency to be determined in an emergency may be a value approximate to the minimum or maximum value.

When the liquid level variation is thereafter brought within the predetermined limits with the liquid level approaching the target value, usual fuzzy control is resumed.

Thus, the control system wherein conventional fuzzy inference is resorted to for fuzzy control is also effective for suppressing variations in the liquid level of the high temperature generator, precluding the chiller from stopping in an emergency.

The emergency is detectable also by checking whether the current value of liquid level has departed from a specified reference range. When the liquid level variation is positive in the case where the current value of liquid level is over the specified upper limit, the inverter frequency is set to the minimum value or a value approximate thereto. If the liquid level variation is negative in the case where the current value of liquid level is below the specified lower limit, the inverter frequency is set to the maximum value or a value approximate thereto.

Incidentally, control systems wherein the main control circuit is adapted for conventional PID control also achieve the same result as described above when an algorithm similar to that shown in FIG. 4 is adopted.

The embodiments described above are intended to illustrate the present invention and should not be construed as limiting the invention defined in the appended claims or reducing the scope thereof. The components of the system of the invention are not limited to those of the embodiments in construction but can of course be modified variously without deparing from the spirit of the invention as set forth in the claims.

For example for predicting liquid level variations, various known predicing means or methods such as neural network are usable in addition to fuzzy inference. Further the emergency rule to be carried out in an emergency can be prescribed, for example, as a fuzzy control rule.

What is claimed is:

1. A control system for an absorption chiller having pump means for recycling an absorbent through a generator and an absorber, the control system being operable for controlling the output of the pump means to maintain the absorbent in the generator at an approximately constant liquid level, the control system comprising:

data detecting means for detecting an item of or different items of operating state data at least including the liquid level of the absorbent in the generator, main control means for carrying out a specified control rule based on the detected operating state data to calculate a control input for the pump means, emergency detecting means for detecting a variation of the liquid level in the generator departing from a predetermined reference range or the liquid level departing from a predetermined reference range as indicating occurrence of an emergency, and emergency control means for stopping the control operation of the main control means upon detection of the emergency and altering the control input for the pump means to the greatest possible extent to make the liquid level approximate to a target value.

2. A control system as defined in claim 1 wherein the main control means comprises fuzzy inference means for predicting a variation in the liquid level from the operating state data received as an input signal, and calculating means for calculating the control input for the pump means based on the predicted liquid level variation.

* * * * *

UNITED STATES PATENT AND TRADEMARK OFFICE

CERTIFICATE OF CORRECTION

PATENT NO. : 5,557,939

DATED : September 24, 1996

INVENTOR(S) : MIZUKAMI et al.

It is certified that error appears in the above-indentified patent and that said Letters Patent is hereby corrected as shown below:

On the title page,

Item [73], delete "Oaska," insert therefor -- Osaka, --

Signed and Sealed this

Twenty-second Day of April, 1997

Bruce Lehman

*Attest:*

BRUCE LEHMAN

*Commissioner of Patents and Trademarks*

*Attesting Officer*